US007214101B1

(12) United States Patent
Tong

(10) Patent No.: US 7,214,101 B1
(45) Date of Patent: May 8, 2007

(54) ELECTRICAL SOCKET WITH DEPENDENT SHUTTER

(75) Inventor: Gabriel Yui Lung Tong, Kowloon (HK)

(73) Assignee: Totex Design Limited, Hong Kong (HK)

( * ) Notice: Subject to any disclaimer, the term of this patent is extended or adjusted under 35 U.S.C. 154(b) by 0 days.

(21) Appl. No.: 11/526,540

(22) Filed: Sep. 25, 2006

(51) Int. Cl.
*H01R 25/00* (2006.01)

(52) U.S. Cl. ..... 439/638; 439/145

(58) Field of Classification Search ..... 439/638, 439/640, 135, 137, 139, 143, 145
See application file for complete search history.

(56) References Cited

U.S. PATENT DOCUMENTS 5,702,259 A * 12/1997 Lee ..... 439/137
6,537,089 B1 * 3/2003 Montague ..... 439/145
6,984,153 B2 * 1/2006 Lai et al. ..... 439/640
2005/0170698 A1 * 8/2005 Lai et al. ..... 439/638
2005/0197015 A1 * 9/2005 Kernan ..... 439/638

* cited by examiner

*Primary Examiner*—Hien Vu
(74) *Attorney, Agent, or Firm*—Renner, Kenner, Greive, Bobak, Taylor & Weber

(57) ABSTRACT

A socket for an electric plug comprising a housing, a first and second pin receptacles, and a shutter mechanism comprising a first and second shield elements, the first and second shield elements, each comprising a detent, and are being joined together by a flexible member, the shutter mechanism being slidingly movable along an axis and also so as to be rotatable about an axis perpendicular to the sliding movement, the shutter mechanism comprising a biasing means for biasing the shutter mechanism into the first position, wherein insertion of only one pin into the first or second pin receptacle so as to contact the first or second shield element causes the shutter mechanism to rotate about the axis perpendicular to the sliding movement bringing the detent of either the first or second shield element into engagement with the housing preventing movement of the shutter mechanism into the second position.

11 Claims, 5 Drawing Sheets

ELECTRICAL SOCKET WITH DEPENDENT SHUTTER

BACKGROUND OF THE INVENTION

The present invention relates to an electrical socket for use with an electrical plug. In particular it relates to an electrical socket comprising means for preventing incorrect insertion of a single plug pin of an electrical plug into the socket.

A plug for use with the socket typically comprises two (Live and Neutral) or three (Live, Neutral & Ground) plug pins. The plug may have different configurations depending on the standards used in each country for electricity supply outlets. For example, in continental Europe the use of Live (L) and Neutral (N) pins only is standard whilst in the United Kingdom three pins are used so as to include a Ground (G) pin otherwise known as an earth pin as well as the L and N pins.

The socket of the present invention may be embodied in a mains socket as found fixedly located in walls or may be embodied as part of an extension cable or as part of a travel adaptor or similar transportable device.

The plug pins are electrically connected to the socket by inserting the plug pins into receptacles formed in the socket. Each plug pin receptacle comprises an electrical contact which permits an electrical connection to be formed between the plug and the socket when the plug pin is inserted into the receptacle.

For safety, it is known in some sockets to provide a shutter that shuts off or covers the socket receptacles when there is no electrical plug being connected to the socket. This is provided to prevent potential electrocution by the insertion of foreign bodies into the receptacles and thereby making contact with, especially, the electrical contact of the Live plug pin receptacle.

An example is a United Kingdom three pin socket. When an electrical plug is inserted into this type of socket, a shutter in the receptacles is activated by the G pin of the electrical plug to move the shutter to expose the L and N receptacles. The G pin is longer than the L and N pins and thus comes into contact with the shutter before the L and N pins when the plug is being inserted into the socket. When the G pin is connected and the shutter is pushed to open, the L and N pins can then be connected to the corresponding receptacles. The shutter cannot be opened by inserting just the L and N pins. A disadvantage is that this type of safety mechanism cannot be used with sockets having only two pins as there is no G pin on the corresponding electric plug which can be used to trigger the shutter.

Sockets without such a shutter have a potential danger of single pin miss-insertion. FIG. 1 shows just the L pin of a three pin plug 101 being inserted to one of the receptacles 102 on prior art socket 103 which does not contain a safety shutter, leaving its N pin 104 and G pin 105 hanging outside the socket 106. The exposed N pin 104 may carry an electric current and cause safety issues if the plug 107 is connected to an electrical outlet in this condition.

As noted above, two-pin sockets cannot use a shutter that is triggered by a G pin. To avoid the danger of single pin insertion, German sockets (which are of the two-pin type) for Schuko plugs are made with receptacles on a surface which are recessed into the body of the socket. The recess is deep enough in relation to the length of the plug pins so that making electric connection is impossible if the plug and pins are not inserted into the socket with the pins and receptacles correctly aligned. This solution can work for mains electric sockets where the size, in particular the depth, of the socket is not of high importance.

Another way to avoid single pin insertion is to make the socket to have the distance between the receptacles and the edge of the socket larger than the distance between the pins of the plug. In this way the housing of the socket itself prevents only one pin being inserted into a receptacle. However, especially for travel adaptors there is a wish to minimise the size of the adaptor and this solution results in a large socket which is not suitable for travelling. Also, design of such a socket requires knowledge of the spacing of the pins on all plugs in different countries that might be used with the adaptor.

There is therefore a need for an electric socket which can operate safely so as to avoid single-pin insertion and be suitable for use with two and three pin designs of sockets and be suitable for use in mains sockets, extension cables and travel adaptors.

SUMMARY OF THE INVENTION

Accordingly the present invention provides a socket for an electric plug of the type comprising a first pin and a second pin, the socket comprising a housing, a first pin receptacle formed in the housing, a second pin receptacle formed in the housing, and a shutter mechanism, the first pin receptacle containing a first contact for making electrical contact with a pin of an electric plug, the second pin receptacle containing a second contact for making electrical contact with a pin of an electric plug, the shutter mechanism comprising a first shield element and a second shield element, the first and second shield elements being joined together by a flexible member, the first and second shield elements each comprising a detent, the shutter mechanism being mounted within the housing so as to be slidingly movable along an axis of sliding movement between a first position and a second position and also so as to be rotatable about an axis perpendicular to the axis of sliding movement, wherein in the first position the first shield element closes off the first pin receptacle and the second shield element closes off the second pin receptacle preventing insertion of a pin of an electric plug into either the first pin receptacle or the second pin receptacle, wherein in the second position the shutter mechanism reveals the first pin receptacle and the second pin receptacle allowing insertion of a first pin of an electric plug into the first pin receptacle so as to contact the first contact and a second pin of an electric plug into the second pin receptacle so as to contact the second contact, the shutter mechanism comprising a biasing means for biasing the shutter mechanism into the first position, wherein insertion of only a single pin into the first or second pin receptacle so as to contact the first or second shield element causes the shutter mechanism to rotate about the axis perpendicular to the axis of sliding movement bringing the detent of either the first or second shield element into engagement with the housing preventing movement of the shutter mechanism into the second position, wherein insertion of a first pin into the first pin receptacle to contact the first shield element at the same time as a second pin into the second pin receptacle to contact the second shield element causes the flexible member to flex and the first and second shield elements to rotate about the axis perpendicular to the axis of sliding movement in opposite senses, thereby freeing the detents of the first shield element and the second shield element from the housing and allowing sliding movement of the shutter mechanism into the second position.

The first and second shield elements may each comprise a slanted surface against which, in use, pins of an electric plug may be pressed to move the shutter mechanism.

The first shield element may comprise an inwardly facing side face and the second shield element comprises an inwardly facing side face, wherein the inwardly facing side faces of the first and second shield elements face each other, wherein the detents of the first and second shield elements project from the inwardly facing side faces of the respective shield element.

The housing may comprise a centrally located projection comprising a first abutment surface for engaging the detent of the first shield element and a second abutment surface for engaging the detent of the second shield element.

The socket may comprise rail members for guiding sliding movement of the shutter mechanism.

The shutter mechanism may be symmetric about the flexible member.

The shutter mechanism may be formed as a single piece.

The socket may be a mains socket, a socket of an extension cable, or a part of an electrical adaptor. The electrical adaptor may also comprise a plug portion.

The socket may further comprise a third pin receptacle.

Embodiments of the present invention will now be described, by way of example, with reference to the accompanying drawings in which:

DETAILED DESCRIPTION OF THE PREFERRED EMBODIMENT

Figure 1:
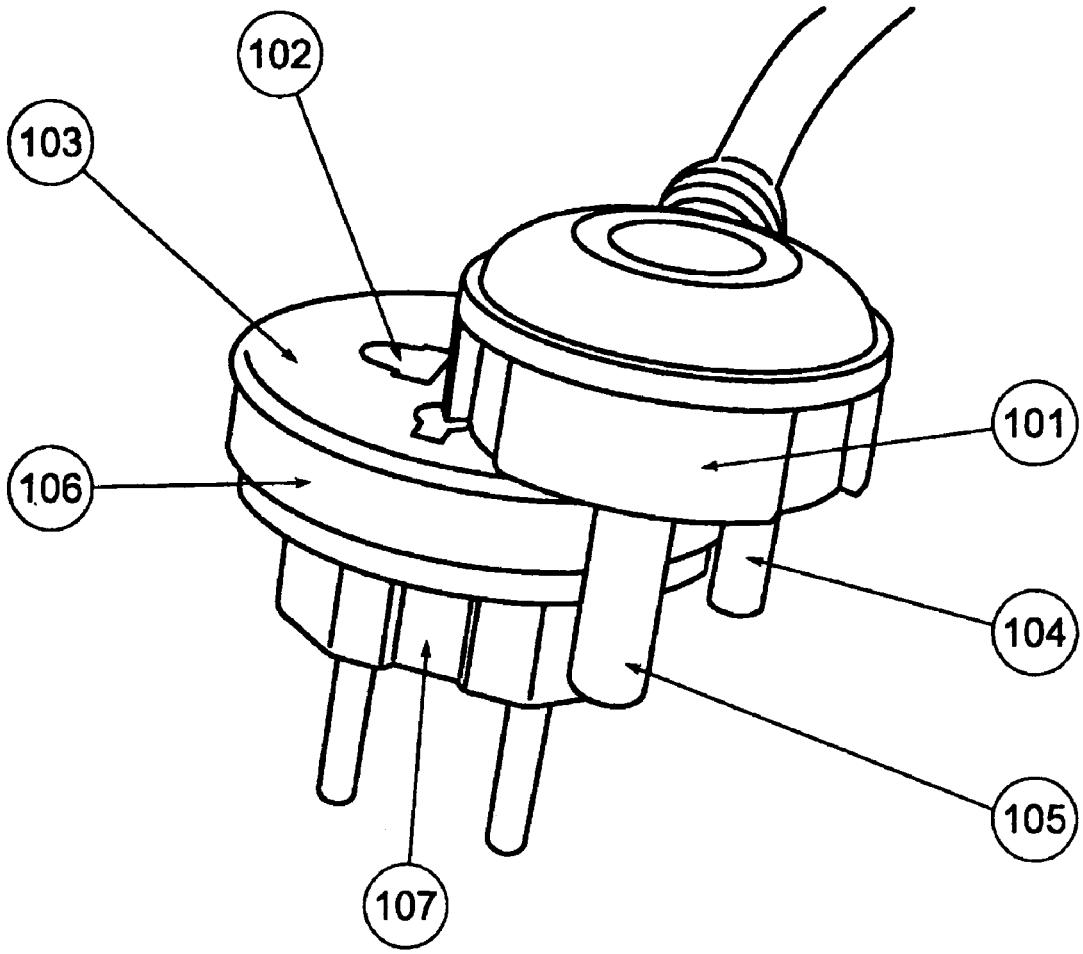
Figure 1 PRIOR ART
FIG. 1, shows a perspective view of a prior art socket with a single pin of an electric plug inserted therein.
Figure 2:
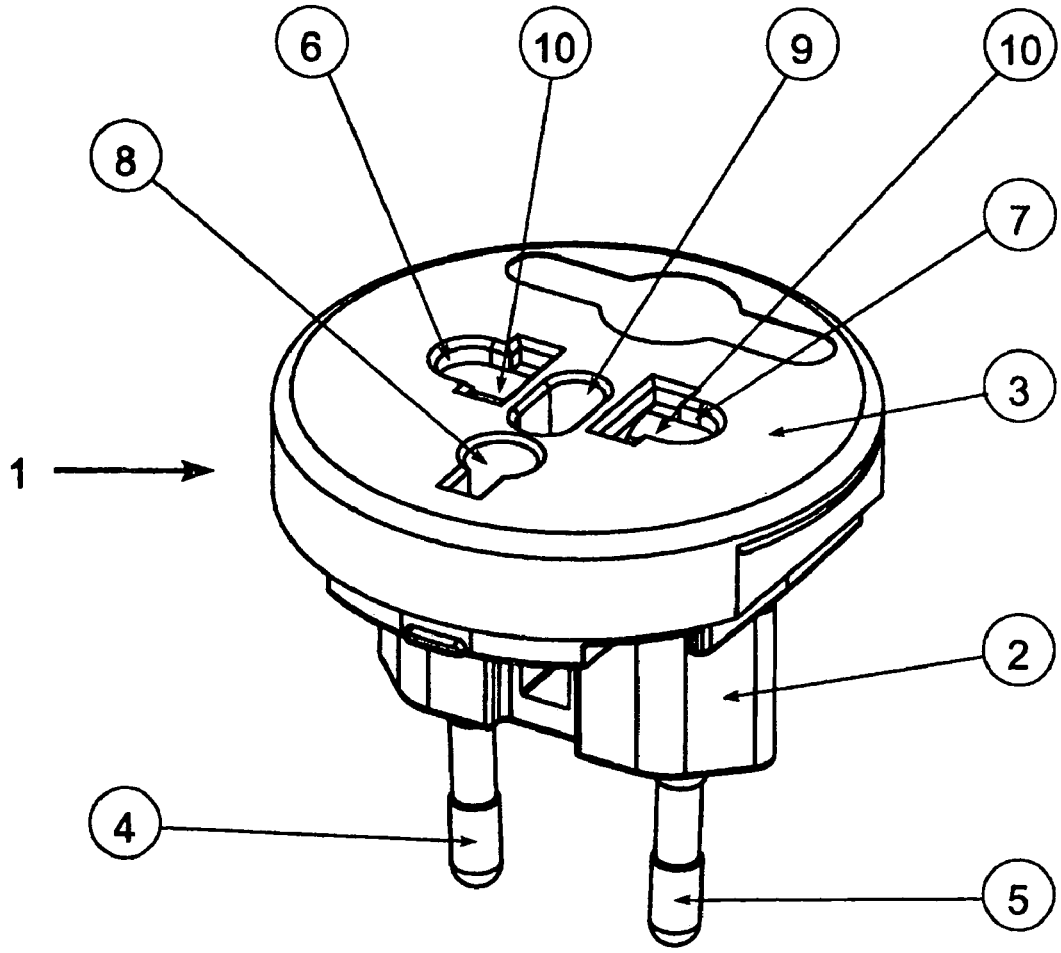
FIG. 2 shows a perspective view of a socket according to the present invention, embodied as part of an adaptor.

The illustrated embodiment provides an electrical adaptor 1 as shown in FIG. 2 comprising a plug part 2 and a socket 3. On plug part 2 are L and N pins 4 and 5. On socket 3 are universal L and N receptacles 6 and 7, and universal G pin receptacles 8 and 9. Within the body of the socket 3 a shutter mechanism 10 is provided for selectively opening and closing the L and N receptacles 6 and 7 as will be described below.

Figure 3:
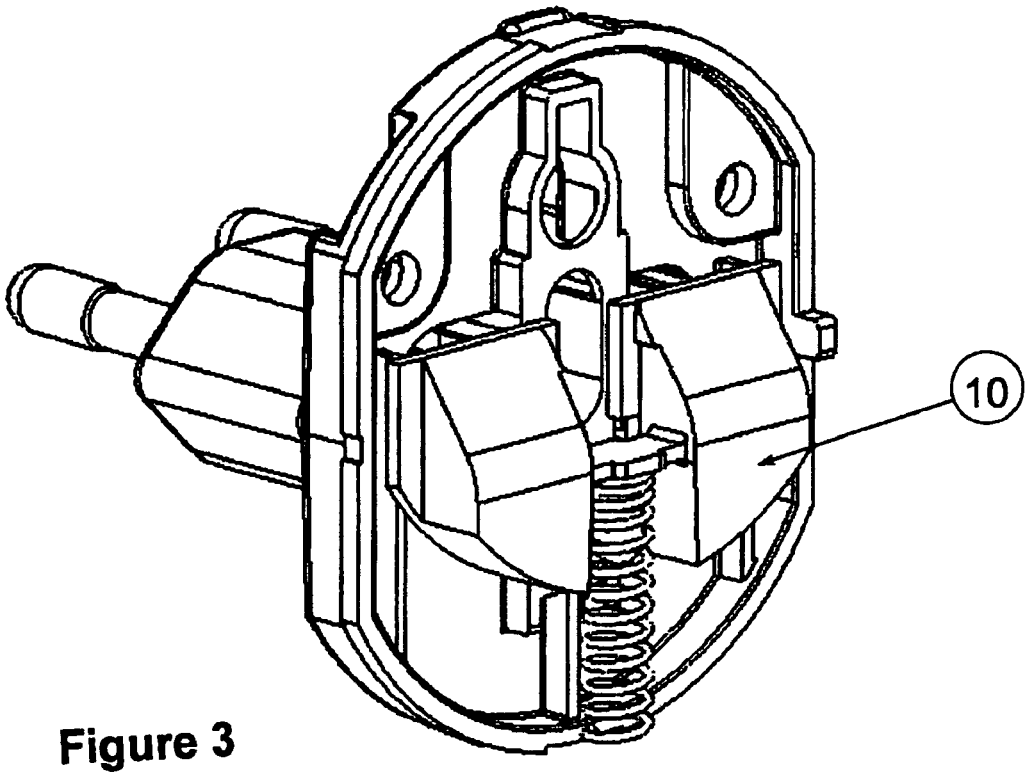
FIG. 3 shows a perspective view of the socket of FIG. 2 with some parts omitted to show internal portions, with a shutter mechanism of the socket in a first position.
Figure 4:
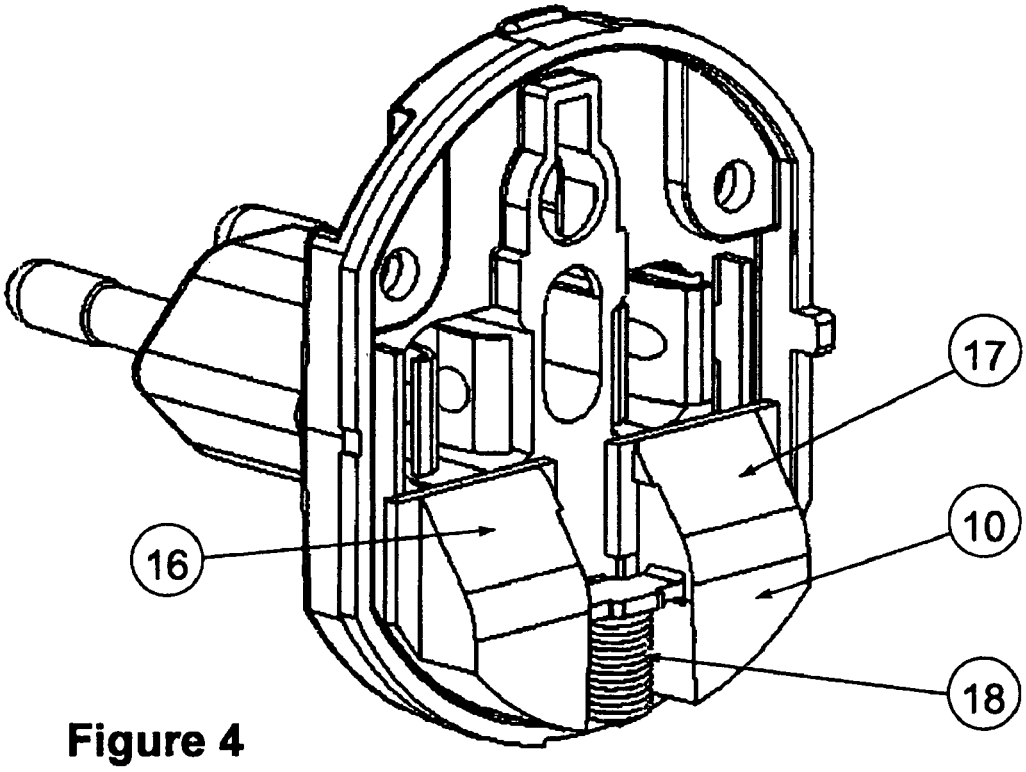
FIG. 4 shows a perspective view of the socket of FIG. 2 with some parts omitted to show internal portions, with the shutter mechanism of the socket in a second position.

FIG. 3 shows the shutter mechanism 10 in the closed position. FIG. 4 shows the shutter mechanism 10 in the open position.

Figure 5:
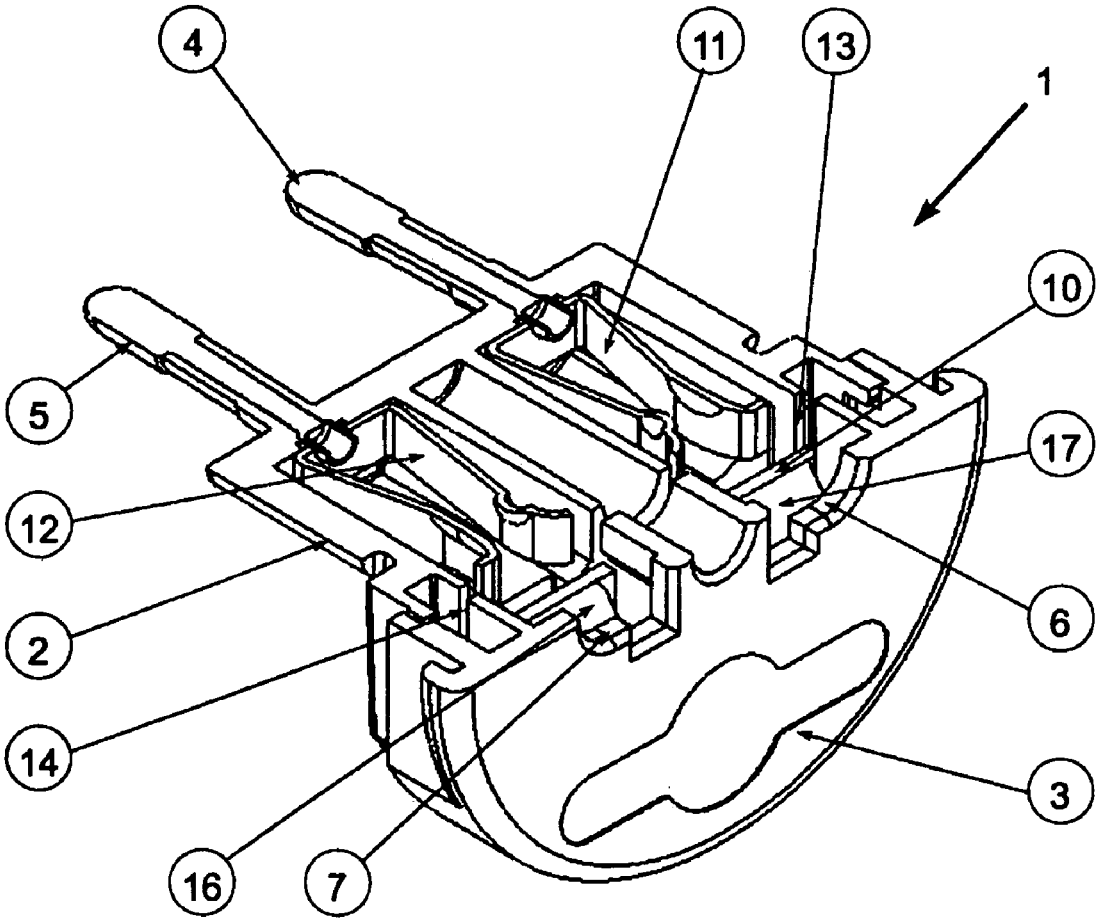
FIG. 5 shows a perspective view of the socket of FIG. 2 in cross-section.

As shown in FIG. 5 the L and N pins 4 and 5 are internally electrically connected to contact plates 11 and 12, inside plug 2, for connection to the plug pins inserted through universal L and N receptacles 6 and 7 on socket 3.

Figure 6A:
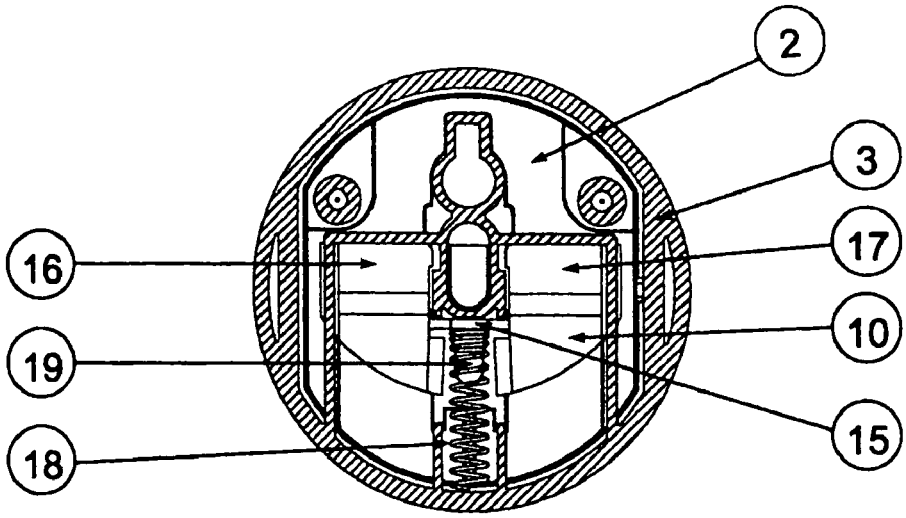
FIGS. 6*a* to 6*c* show schematically the operation of the shutter mechanism of the socket of FIG. 2.

As seen most clearly in FIGS. 3 and 4, the shutter mechanism comprises two shield elements 16, 17 joined together by means of a flexible member 15 in the form of a bridge. On bridge 15 a downwardly expending rod 19 is provided which holds in place one end of a spring 18 which extends between the bridge 15 and a bottom surface of the housing of the socket 3 so as to bias the shutter mechanism 10 into the closed position as shown in FIG. 3. The shield elements 16, 17 each comprise a slanted surface directed away from rod 19 so as to be directed generally towards an upper portion of the socket 3 in the orientation shown in FIG. 3. In the closed position shown in FIG. 3 the slanted surfaces 16, 17 overly and close off the receptacles 6, 7. The shield elements each comprise a detent 20, 22 formed towards an upper edge of the shield element on an inwardly facing side face of the shield elements 16, 17 as shown in FIGS. 3 and 6*a*. The housing of the socket 3 comprises two abutments 21, 23 formed on a centrally located projection. The abutments are on side faces of the projection facing towards the detents 20, 22.

The shutter mechanism is slidably movable within the socket 3 along an axis of sliding movement. The sliding movement of the shutter mechanism is guided by rails 13, 14 formed as part of the socket housing.

It will be noted that the shutter mechanism is symmetric about the bridge 15.

In use, when the slanted surfaces 16 and 17 of the shield elements are pressed at the same time by the L and N pins of any two or three pin plug, the shutter mechanism 10 is forced to slide to the open position as shown in FIG. 4, resulting in the spring 18 being compressed. Thus the L and N plug pins can be fully inserted into the electrical adaptor to make electrical connection. When the two or three pins plug is removed from the electrical adaptor, spring 18 will push shutter mechanism 10 to slide back to the closed position.

Figure 6B:
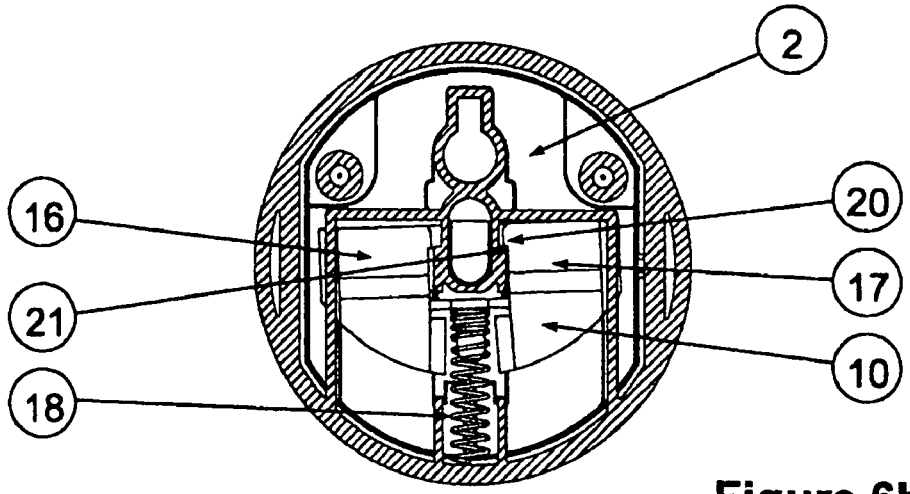

If only one pin is inserted into either receptacle 6 or 7, the shutter mechanism 10 will not open and the pin cannot be inserted through to make electrical connection with the electric contact. As shown in FIG. 6*b*, when only the slanted surface 16's side is being pushed by a single pin, shutter mechanism 10 starts turning about an axis perpendicular to the direction of sliding movement before it will slide. When the shutter mechanism 10 turns, detent 20 is engaged against abutment 21 of the socket 3, stopping the shutter mechanism 10 from sliding. Thus, the shutter mechanism 10 does not open and single pin insertion is avoided. The effect is the same when a single pin is being inserted to the slanted surface 17's side, because of the symmetrical construction.

Figure 6C:
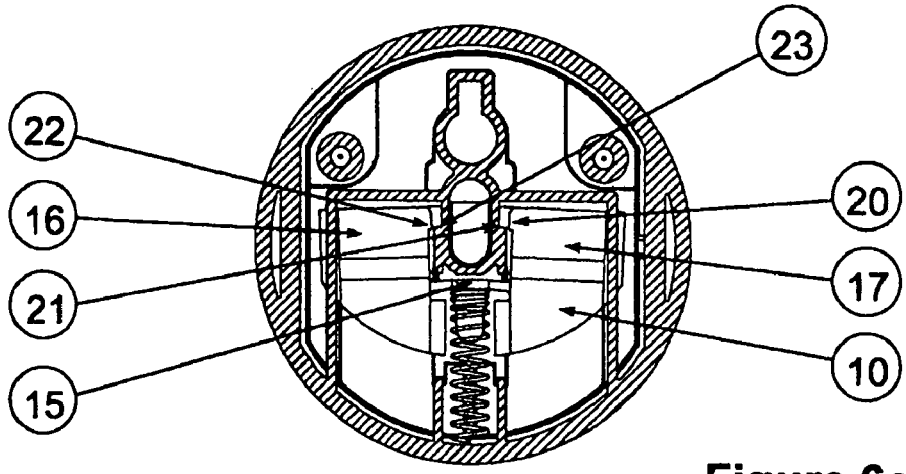

When a plug is properly inserted, its L and N pins shall be inserted into the receptacles at more or less the same time. But if one is touching the slanted surface 16 or 17 earlier than the other, detent 20 or 22 as indicated in FIG. 6*b* will engage against either abutment 21 or 23, locking the shutter mechanism 10 in the closed position. Continued insertion of the plug will force both the L and N pins correspondingly against the slanted surfaces 16 and 17. Once both shield elements 16, 17 are pressed by pins the shield elements will be forded to rotate in opposite senses about the axis of rotation as shown in FIG. 6*c*. This movement is accommodated by flexure of the flexible member of the bridge 15. Consequently, both detents 20, 22 are disengaged from their respective abutments 21, 23 as the opposite rotation of the shield elements results in the distance between the detents 20, 22 becoming greater than the distance from edge to edge of the abutments 21, 23. As shown in FIG. 6*c*, the shutter mechanism 10 will then be movable to the open position allowing the two plug pins to make electrical connection when fully inserted.

In the above embodiment the invention has been illustrated as part of a travel adaptor. It will be understood that the invention extends to all manner of electric sockets including, but not limited to, mains sockets and extension cable sockets.

The invention claimed is:

1. A socket for an electric plug of the type comprising a first pin and a second pin, the socket comprising a housing, a first pin receptacle formed in the housing, a second pin receptacle formed in the housing, and a shutter mechanism, the first pin receptacle containing a first contact for making electrical contact with a pin of an electric plug, the second pin receptacle containing a second contact for making electrical contact with a pin of an electric plug, the shutter mechanism comprising a first shield element and a second shield element, the first and second shield elements being joined together by a flexible member and the flexible member being positioned in between the first and second shield elements, the first and second shield elements each comprising a detent, the shutter mechanism being mounted within the housing so as to be slidingly movable along an axis of sliding movement between a first position and a second position and also so as to be rotatable about an axis perpendicular to the axis of sliding movement, wherein in the first position the first shield element closes off the first pin receptacle and the second shield element closes off the second pin receptacle preventing insertion of a pin of an electric plug into either the first pin receptacle or the second pin receptacle, wherein in the second position the shutter mechanism reveals the first pin receptacle and the second pin receptacle allowing insertion of a first pin of an electric plug into the first pin receptacle so as to contact the first contact and a second pin of an electric plug into the second pin receptacle so as to contact the second contact, the shutter mechanism comprising a biasing means for biasing the shutter mechanism into the first position, wherein insertion of only a single pin into the first or second pin receptacle so as to contact the first or second shield element causes the shutter mechanism to rotate about the axis perpendicular to the axis of sliding movement bringing the detent of either the first or second shield element into engagement with the housing preventing movement of the shutter mechanism into the second position, wherein insertion of a first pin into the first pin receptacle to contact the first shield element at the same time as a second pin into the second pin receptacle to contact the second shield element causes the flexible member to flex and the first and second shield elements to rotate about the axis perpendicular to the axis of sliding movement in opposite senses, thereby freeing the detents of the first shield element and the second shield element from the housing and allowing sliding movement of the shutter mechanism into the second position, wherein the housing comprises a centrally located projection comprising a first abutment surface for engaging the detent of the first shield element and a second abutment surface for engaging the detent of the second shield element.

2. A socket as claimed in claim 1 wherein the first and second shield elements each comprise a slanted surface against which, in use, pins of an electric plug may be pressed to move the shutter mechanism.

3. A socket as claimed in claim 1 wherein the first shield element comprises an inwardly facing side face and the second shield element comprises an inwardly facing side face, wherein the inwardly facing side faces of the first and second shield elements face each other, wherein the detents of the first and second shield elements project from the inwardly facing side faces of the respective shield element.

4. A socket as claimed in claim 1 wherein the socket comprises rail members for guiding sliding movement of the shutter mechanism.

5. A socket as claimed in claim 1 wherein the shutter mechanism is symmetric about the flexible member.

6. A socket as claimed in claim 1 wherein the shutter mechanism is formed as a single piece.

7. A socket as claimed in claim 1 wherein the socket is a mains socket.

8. A socket as claimed in claim 1 wherein the socket is a socket of an extension cable.

9. A socket as claimed in claim 1 wherein the socket is a part of an electrical adaptor.

10. A socket as claimed in claim 9 wherein the electrical adaptor also comprises a plug portion.

11. A socket as claimed in claim 1 further comprising a third pin receptacle.

* * * * *